US007458425B2

(12) United States Patent
Millheim et al.

(10) Patent No.: US 7,458,425 B2
(45) Date of Patent: Dec. 2, 2008

(54) SYSTEM AND METHOD OF INSTALLING AND MAINTAINING AN OFFSHORE EXPLORATION AND PRODUCTION SYSTEM HAVING AN ADJUSTABLE BUOYANCY CHAMBER

(75) Inventors: Keith K. Millheim, The Woodlands, TX (US); Eric E. Maidla, Sugar Land, TX (US); Charles H. King, Austin, TX (US)

(73) Assignee: Anadarko Petroleum Corporation, The Woodlands, TX (US)

( * ) Notice: Subject to any disclaimer, the term of this patent is extended or adjusted under 35 U.S.C. 154(b) by 500 days.

(21) Appl. No.: 10/994,799

(22) Filed: Nov. 22, 2004

(65) Prior Publication Data

US 2006/0042800 A1 Mar. 2, 2006

Related U.S. Application Data

(60) Provisional application No. 60/606,335, filed on Sep. 1, 2004.

(51) Int. Cl.
*E21B 29/12* (2006.01)

(52) U.S. Cl. ..... 166/355; 166/350; 166/367

(58) Field of Classification Search ..... 166/338, 166/344, 350, 355, 367
See application file for complete search history.

(56) References Cited

U.S. PATENT DOCUMENTS

| | | | | |
|---|---|---|---|---|
| 3,017,934 | A | 1/1962 | Rhodes et al. | |
| 3,179,179 | A | 4/1965 | Kofahl | |
| 3,280,908 | A | 10/1966 | Todd | |
| 3,363,683 | A * | 1/1968 | Corley, Jr. et al. | 166/355 |
| 3,705,623 | A | 12/1972 | van Eek et al. | |
| 3,722,584 | A * | 3/1973 | Nelson | 166/350 |

(Continued)

FOREIGN PATENT DOCUMENTS

| | | |
|---|---|---|
| EP | 0 277 840 A2 | 8/1988 |

(Continued)

OTHER PUBLICATIONS

Anadarko Petroleum Corporation Modular Exploration Production System (MEPS); Adjustable Buoyance Chamber (ABC) Conceptual Design.

(Continued)

*Primary Examiner*—Thomas A Beach
(74) *Attorney, Agent, or Firm*—Raymond R. Ferrera

(57) ABSTRACT

A system and method of establishing an offshore exploration and production system is disclosed, in which a well casing is disposed in communication with an adjustable buoyancy chamber and a well hole bored into the floor of a body of water. A lower connecting member joins the well casing and the chamber, and an upper connecting member joins, the adjustable buoyancy chamber and a well terminal member. The chamber's adjustable buoyancy enables an operator to vary the height or depth of the well terminal member, and to vary the vertical tension imparted to drilling and production strings throughout exploration and production operations. Also disclosed is a system and method of adjusting the height or depth of a wellhead while associated vertical and lateral forces remain approximately constant. A variety of well isolation members, lateral stabilizers and anchoring means, as well as several methods of practicing the invention, are also disclosed.

71 Claims, 3 Drawing Sheets

U.S. PATENT DOCUMENTS

| | | | | | |
|---|---|---|---|---|---|
| 3,855,656 | A | * | 12/1974 | Blenkarn | 441/22 |
| 4,099,560 | A | * | 7/1978 | Fischer et al. | 166/350 |
| 4,176,986 | A | * | 12/1979 | Taft et al. | 405/211 |
| 4,216,834 | A | * | 8/1980 | Wardlaw | 175/7 |
| 4,223,737 | A | | 9/1980 | O'Reilly | |
| 4,305,468 | A | | 12/1981 | Goldsmith | |
| 4,386,659 | A | * | 6/1983 | Shotbolt | 166/342 |
| 4,448,266 | A | * | 5/1984 | Potts | 175/7 |
| 4,617,998 | A | * | 10/1986 | Langner | 166/345 |
| 4,646,840 | A | * | 3/1987 | Bartholomew et al. | 166/350 |
| 4,702,320 | A | * | 10/1987 | Gano et al. | 166/343 |
| 4,702,321 | A | * | 10/1987 | Horton | 166/350 |
| 4,735,267 | A | * | 4/1988 | Stevens | 166/345 |
| 4,832,126 | A | | 5/1989 | Roche | |
| 4,892,495 | A | * | 1/1990 | Svensen | 441/5 |
| 5,379,844 | A | | 1/1995 | Glasscock et al. | |
| 5,524,710 | A | | 6/1996 | Shinn | |
| 5,727,640 | A | | 3/1998 | Gleditsch | |
| 5,778,981 | A | * | 7/1998 | Head | 166/345 |
| 5,860,840 | A | | 1/1999 | Boatman et al. | |
| 6,004,074 | A | * | 12/1999 | Shanks, II | 405/195.1 |
| 6,042,303 | A | * | 3/2000 | Head | 405/195.1 |
| 6,155,748 | A | * | 12/2000 | Allen et al. | 405/195.1 |
| 6,196,322 | B1 | | 3/2001 | Magnussen | |
| 6,244,785 | B1 | * | 6/2001 | Richter et al. | 405/195.1 |
| 6,422,324 | B1 | * | 7/2002 | Tibussek et al. | 175/5 |
| 6,431,285 | B2 | | 8/2002 | Hopper et al. | |
| 6,497,286 | B1 | | 12/2002 | Hopper | |
| 6,595,725 | B1 | * | 7/2003 | Shotbolt | 405/224.2 |
| 6,601,656 | B2 | | 8/2003 | Hopper et al. | |
| 6,672,390 | B2 | | 1/2004 | Azancot | |
| 6,725,936 | B2 | | 4/2004 | Hopper | |
| 2001/0047869 | A1 | | 12/2001 | Hopper et al. | |
| 2002/0157866 | A1 | | 10/2002 | Hopper et al. | |
| 2003/0051880 | A1 | | 3/2003 | Hopper | |
| 2003/0180097 | A1 | * | 9/2003 | Fitzgerald et al. | 405/224.2 |
| 2005/0109513 | A1 | * | 5/2005 | Dailey et al. | 166/350 |

FOREIGN PATENT DOCUMENTS

| | | | |
|---|---|---|---|
| EP | 0802302 | A1 | 10/1997 |
| GB | 2337068 | A | 11/1999 |
| RU | 2011791 | C1 | 4/1994 |
| RU | 2081304 | C1 | 6/1997 |

OTHER PUBLICATIONS

Anadarko Petroleum Corporation Modular Exploration Productin System (MEPS); Option B Adjustable Buoyancy Chamber (ABC2) Conceptual Design.

The Atlantis Artificial Seabed Concept, Atlantis Applications, Sep. 29, 2004.

A step change in deepwater technology, Technology, Apr. 2004.

Artificial buoyant seabed aids deepwater E&P, Drilling Contractor, Sep./Oct. 2003.

The Atlantis Artificial Seabed Concept for Deepwater Exploration Drilling, Field Development and Riser Tower Applications, Atlantis Deepwater Technology Holding AS, 2003.

The STL System (the proven and standardised system for offshore oil loading), Advanced Production and Loading AS (4 pgs).

* cited by examiner

SYSTEM AND METHOD OF INSTALLING AND MAINTAINING AN OFFSHORE EXPLORATION AND PRODUCTION SYSTEM HAVING AN ADJUSTABLE BUOYANCY CHAMBER

RELATED APPLICATION

The instant application is a continuation-in-part of prior provisional application No. 60/606,335 filed Sep. 1, 2004.

FIELD OF THE INVENTION

The present invention relates generally to oil and gas exploration and production, and in a specific, non-limiting embodiment, to a system and method of installing and maintaining an offshore exploration and production system having an adjustable buoyancy chamber.

BACKGROUND OF THE INVENTION

Innumerable systems and methods have been employed in efforts to find and recover hydrocarbon reserves around the world. At first, such efforts were limited to land operations involving simple but effective drilling methods that satisfactorily recovered reserves from large, productive fields. As the number of known producing fields dwindled, however, it became necessary to search in ever more remote locales, and to move offshore, in the search for new resources. Eventually, sophisticated drilling systems and advanced signal processing techniques enabled oil and gas companies to search virtually anywhere in the world for recoverable hydrocarbons.

Initially, deepwater exploration and production efforts consisted of expensive, large scale drilling operations supported by tanker storage and transportation systems, due primarily to the fact that most offshore drilling sites are associated with difficult and hazardous sea conditions, and thus large scale operations provided the most stable and cost-effective manner in which to search for and recover hydrocarbon reserves. A major drawback to the large-scale paradigm, however, is that explorers and producers have little financial incentive to work smaller reserves, since potential financial recovery is generally offset by the lengthy delay between exploration and production (approximately 3 to 7 years) and the large capital investment required for conventional platforms and related drilling and production equipment. Moreover, complex regulatory controls and industry-wide risk aversion have led to standardization, leaving operators with few opportunities to significantly alter the prevailing paradigm. As a result, offshore drilling operations have traditionally been burdened with long delays between investment and profit, excessive cost overruns, and slow, inflexible recovery strategies dictated by the operational environment.

More recently, deepwater sites have been found in which much of the danger and instability present in such operations is avoided. For example, off the coast of West Africa, Indonesia and Brazil, potential drilling sites have been identified where surrounding seas and weather conditions are relatively mild and calm in comparison to other, more volatile sites such as the Gulf of Mexico and the North Sea. These recently discovered sites tend to have favorable producing characteristics, yield positive exploration success rates, and admit to production using simple drilling techniques similar to those employed in dry land or near-shore operations.

However, since lognormal distributions of recoverable reserves tend to be spread over a large number of small fields, each of which yield less than would normally be required in order to justify the expense of a conventional large-scale operation, these regions have to date been underexplored and underproduced relative to its potential. Consequently, many potentially productive smaller fields have already been discovered, but remain undeveloped due to economic considerations. In response, explorers and producers have adapted their technologies in an attempt to achieve greater profitability by downsizing the scale of operations and otherwise reducing expense, so that recovery from smaller fields makes more financial sense, and the delay between investment and profitability is reduced.

For example, in published Patent Application No. US 2001/0047869 A1 and a number of related pending applications and patents issued to Hopper et al., various methods of drilling deepwater wells are provided in which adjustments to the drilling system can be made so as to ensure a better recovery rate than would otherwise be possible with traditional fixed-well technologies. However, the Hopper system cannot be adjusted during completion, testing and production of the well, and is especially ineffective in instances where the well bore starts at a mud line in a vertical position. The Hopper system also fails to support a variety of different surface loads, and is therefore self-limiting with respect to the flexibility drillers desire during actual operations.

In U.S. Pat. No. 4,223,737 to O'Reilly, a method is disclosed in which the problems associated with traditional, vertically oriented operations are addressed. The method of O'Reilly involves laying out a number of interconnected, horizontally disposed pipes in a string just above the sea floor (along with a blow out preventer and other necessary equipment), and then using a drive or a remote operated vehicle to force the string horizontally into the drilling medium. The O'Reilly system, however, is inflexible in that it fails to admit to practice while the well is being completed and tested. Moreover, the method utterly fails to contemplate functionality during production and workover operations. In short, the O'Reilly reference is helpful only during the initial stages of drilling a well, and would therefore not be looked to as a systemic solution for establishing and maintaining a deepwater exploration and production operation.

Other offshore operators have attempted to solve the problems associated with deepwater drilling by effectively "raising the floor" of an underwater well by disposing a submerged wellhead above a self-contained, rigid framework of pipe casing that is tensioned by means of a gas filled, buoyant chamber. For example, as seen in prior U.S. Pat. No. 6,196,322 B1 to Magnussen, the Atlantis Deepwater Technology Holding Group has developed an artificial buoyant seabed (ABS) system, which is essentially a gas filled buoyancy chamber deployed in conjunction with one or more segments of pipe casing disposed at a depth of between 600 and 900 feet beneath the surface of a body of water. After the ABS wellhead is fitted with a blowout preventer during drilling, or with a production tree during production, buoyancy and tension are imparted by the ABS to a lower connecting member and all internal casings. The BOP and riser (during drilling) and production tree (during production), are supported by the lifting force of the buoyancy chamber. Offset of the wellhead is reasonably controlled by means of vertical tension resulting from the buoyancy of the ABS.

The Atlantis ABS system is deficient, however, in several practical respects. For example, the '322 Magnussen patent specifically limits deployment of the buoyancy chamber to environments where the influence of surface waves is effectively negligible, i.e., at a depth of more than about 500 feet beneath the surface. Those of ordinary skill in the art will appreciate that deployment at such depths is an expensive and relatively risk-laden solution, given that installation and maintenance can only be carried out by deep sea divers or remotely operated vehicles, and the fact that a relatively extensive transport system must still be installed between the top of the buoyancy chamber and the bottom of an associated recovery vessel in order to initiate production from the well.

The Magnussen system also fails to contemplate multiple anchoring systems, even in instances where problematic drilling environments are likely to be encountered. Moreover, the system lacks any control means for controlling adjustment of either vertical tension or wellhead depth during production and workover operations, and expressly teaches away from the use of lateral stabilizers that could enable the wellhead to be deployed in shallower waters subject to stronger tidal and wave forces.

Thus, there is plainly a widespread need for a system and method of disposing an offshore wellhead in a manner such that drillers can adjust both the depth of a wellhead and the vertical tension applied to associated pipe casing throughout the duration of exploration and production operations. There is also a need for an adjustable buoyancy chamber system capable of maintaining approximately constant vertical tension on an associated drilling or production string, and adjusting either the height of a wellhead at any time during exploration and production by releasing additional lengths of tension line from a buoyancy chamber height adjustment member. There is also a need for an offshore exploration and production system that flexibly admits to use in connection with both deepwater and shallow target horizons, without necessarily being configured to conform to any particular operational depth.

SUMMARY OF THE INVENTION

A system and method of establishing an offshore exploration and production system is provided, in which a well casing is disposed in communication with an adjustable buoyancy chamber and a well hole bored into the floor of a body of water. A lower connecting member joins the well casing and the chamber, and an upper connecting member joins the adjustable buoyancy chamber and a well terminal member. The chamber's adjustable buoyancy enables an operator to vary the height or depth of the well terminal member, and to vary the vertical tension imparted to drilling and production strings throughout exploration and production operations. Also provided is a system and method of adjusting the height or depth of a wellhead while associated vertical and lateral forces remain approximately constant. A variety of well isolation members, lateral stabilizers and anchoring means, as well as several methods of practicing the invention, are also disclosed.

DETAILED DESCRIPTION

Figure 1A:
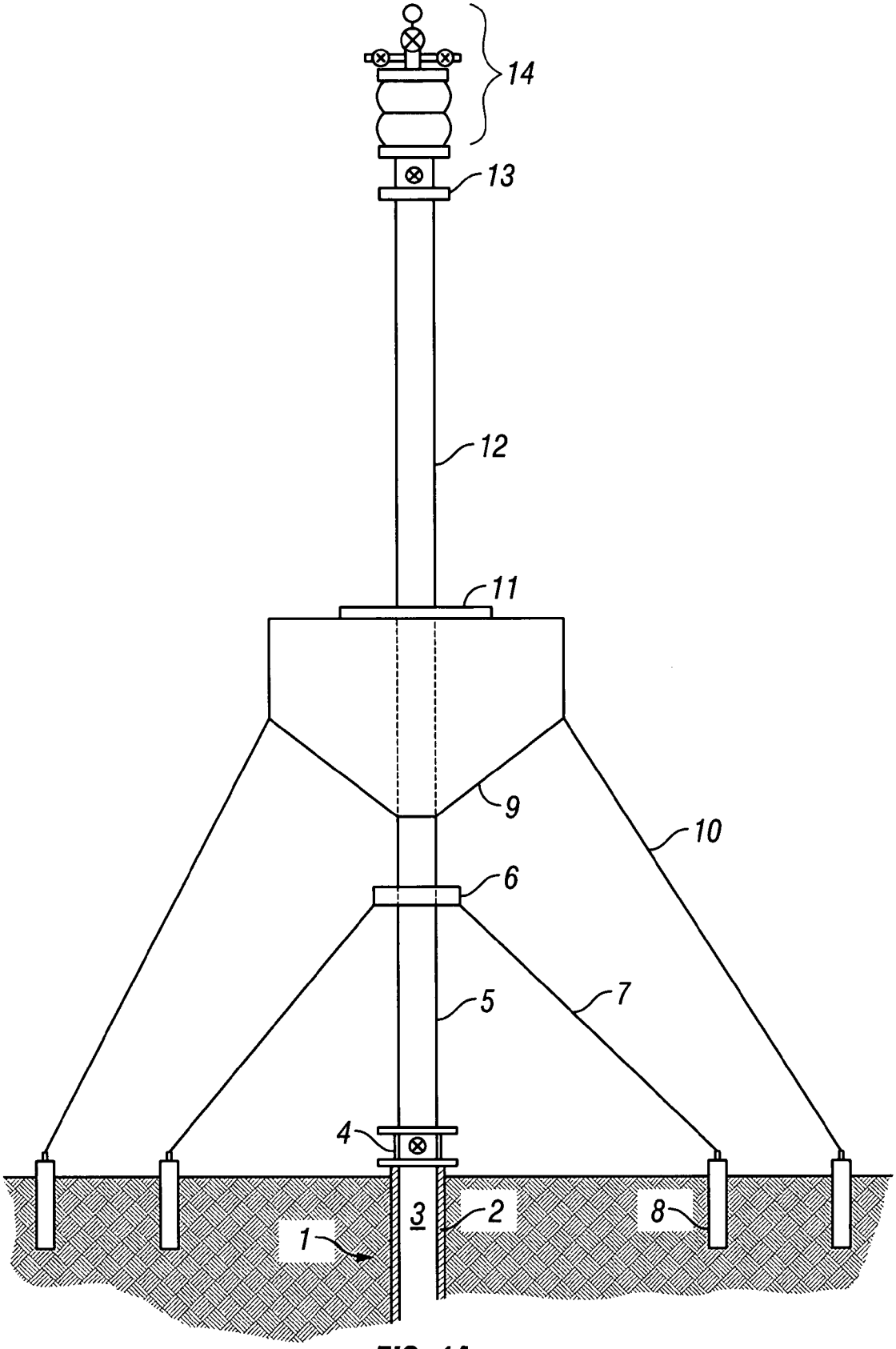
FIGS. 1A and 1B are side views of an offshore exploration and production system in which an adjustable buoyancy chamber is employed to adjust the height or depth of an associated well terminal member.
Figure 1B:
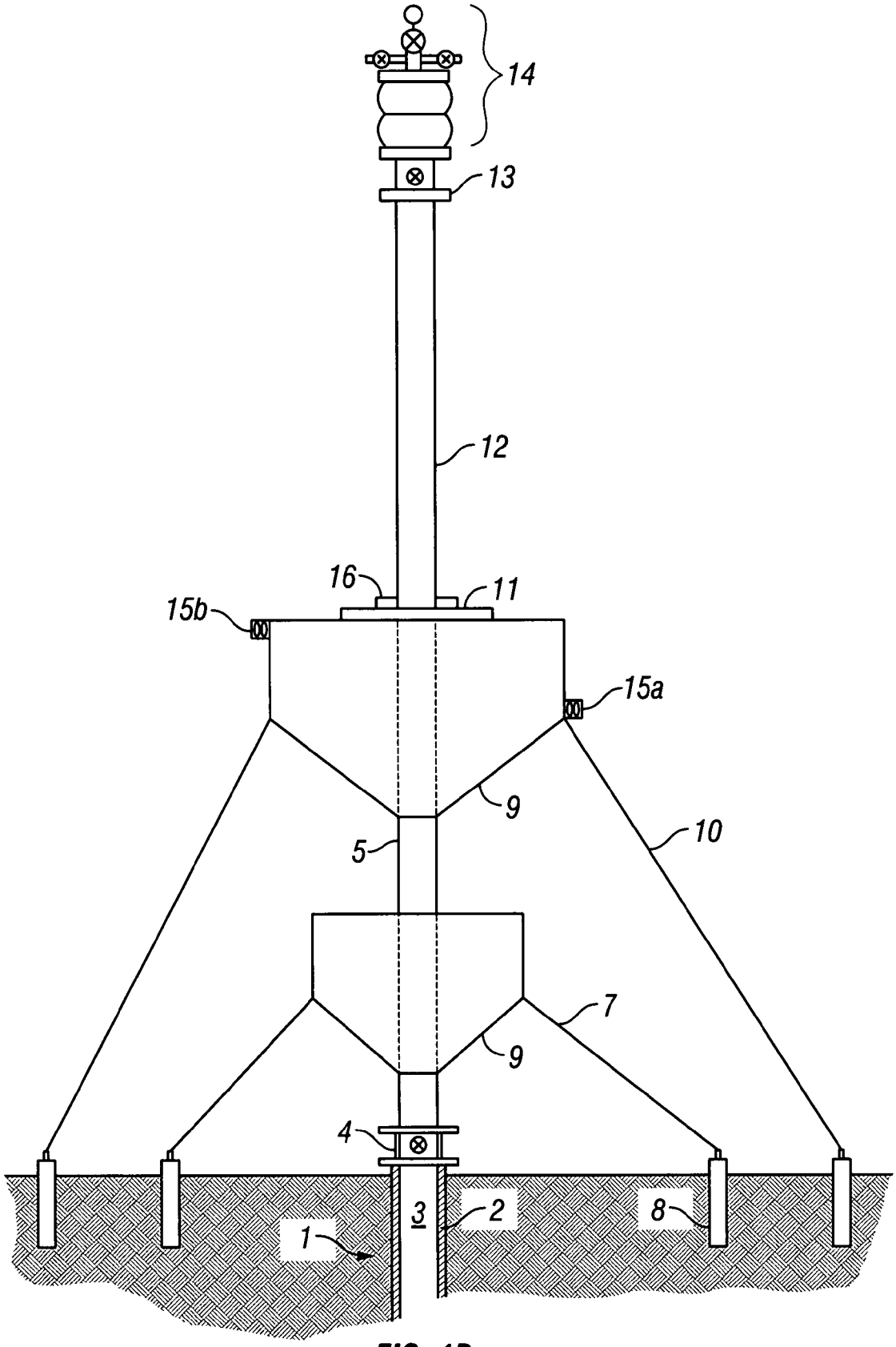

Referring now to the specific, non-limiting embodiment of the invention depicted in FIGS. 1A and 1B, an offshore exploration and production system is provided, comprising a well casing 2 installed in communication with a submerged well 1 and an adjustable buoyancy chamber 9, wherein a lower connecting member 5 is disposed between the well casing and the adjustable buoyancy chamber. In a presently preferred embodiment, the well 1 is accessed from above by means of a well hole 3 that has been bored into an associated sea floor surface. In a typical embodiment, a well casing 2 is set into the hole in a firm and secure manner, and then cemented into place using known downhole technology. In other embodiments, a well casing is securely set into the well hole 3, and a fluid transport member, such as a smaller-diameter pipe or pipe casing, is inserted into well casing 2. Once a desired fit has been achieved, the outer surface of the fluid transport member is cemented or set with a packer to the inner surface of the well casing. Those of ordinary skill in the art will appreciate that while the embodiment described above refers to but a single well, the offshore exploration and production system disclosed herein can be readily adapted to simultaneously work multiple neighboring wells without departing from the scope or spirit of the invention.

In the example embodiment depicted in FIG. 1A, a well isolation member 4 is disposed between well casing 2 and a lower connecting member 5. In some embodiments, well isolation member 4 comprises one or more ball valves, which, if lower connecting member 5 is removed, can be closed so that the well is effectively shut in. In further embodiments, well isolation member 4 comprises a blowout preventer or a shear ram that can be maintained in either an open or closed position in order to provide access to, or to instead shut in, the contents of well 1.

In other embodiments, lower connecting member 5 further comprises one or more receiving members disposed to receive an attachment member disposed on well isolation member 4. In an alternative embodiment, lower connecting member 5 comprises an attachment member for attaching said lower connecting member 5 to a receiving member disposed on well isolation member 4. Methods and means of securely fastening lower connecting member 5 to well isolation member 4 are known to those of ordinary skill in the art, and may comprise one or more of a wide variety of fastening techniques, e.g., hydraulic couplers, various nut and bolt assemblies, welded joints, pressure fittings (either with or without gaskets), swaging, etc., without departing from the scope or spirit of the present invention.

Likewise, lower connecting member 5 may comprise any known connecting means appropriate for the specific application contemplated by operators. For example, in various embodiments, lower connecting member 5 comprises one or more of segments of riser, riser pipe, and/or pipe casing. In some embodiments, lower connecting member 5 comprises a concentric arrangement, for example, a fluid transport member having a smaller outer diameter than the inner diameter of a pipe casing in which the fluid transport member is housed.

In further embodiments, lower connecting member 5 is disposed in communication with one or more lateral stabilizers 6, which, when deployed in conjunction a plurality of tension lines 7, effectively controls horizontal offset of the system. By utilizing the buoyant forces of adjustable buoyancy chamber 9, lower connecting member 5 is drawn taut and held in a stable position.

In an alternative embodiment, one or more stabilizers 6 control horizontal offset of lower connecting member 5, and the height or depth of an associated well terminal member 14 is adjusted by varying the length of upper connecting member 12. In some embodiments, the vertical tension of lower connecting member 5 is held approximately constant while the height or depth of well terminal member 14 is adjusted. In further embodiments, the height or depth of well terminal member 14 is held approximately constant, while the vertical tension imparted by adjustable buoyancy chamber 9 on lower connecting member 5 is adjusted. In still further embodiments, the height or depth of well terminal member 14 and the vertical tension applied to lower connecting member 5 are held approximately constant, while lateral adjustments are performed using lateral stabilizer 6 and one or more of tension lines 7.

In certain embodiments, one or more lateral tension lines 7 are individually adjustable, whereas in other embodiments, the tension lines 7 are collectively adjustable. In further embodiments, one or more tension lines 7 are both individually and collectively adjustable. In still further embodiments, the one or more lateral stabilizers 6 are disposed in communication with a tension measuring means, so that a fixed or predetermined amount of lateral tension can be applied to lower connecting member 5 in order to better control system offset. In some embodiments, the tension lines 7 are anchored to the sea floor by means of an anchoring member 8, for example, a suction type anchor, or alternatively, a mechanical or conventional deadweight type anchor.

In a presently preferred embodiment, adjustable buoyancy chamber 9 is approximately annular in shape, so that lower connecting member 5 can be passed through a void longitudinally disposed in a central portion of the device. In further embodiments, adjustable buoyancy chamber 9 further comprises a plurality of inner chambers. In still further embodiments, each of the chambers is independently operable, and different amounts of air or gas (or another fluid) are disposed in the chambers to provide greater adjustable buoyancy control. In one example embodiment, adjustable buoyancy chamber 9 further comprises a fluid ballast that can be ejected from the chamber, thereby achieving greater chamber buoyancy and lending additional vertical tension to lower connecting member 5. Those of ordinary skill in the art will appreciate that many appropriate fluid ballast can be used to increase or retard buoyancy; for example, compressed air is an appropriate fluid that is both inexpensive and readily available.

In some embodiments, adjustable buoyancy chamber 9 further comprises a ballast input valve 15*a*, so that a fluid ballast can be injected into the chamber from an external source, for example, through an umbilical line run to the surface or a remote operated vehicle, so that an operator can deliver a supply of compressed gas to the chamber via the umbilical, thereby adjusting buoyancy characteristics as desired. In other embodiments, the fluid input valve is disposed in communication with one or more pumps or compressors, so that the fluid ballast is delivered to the chamber under greater pressure, thereby effecting the desired change in buoyancy more quickly and reliably.

In other embodiments, adjustable buoyancy chamber 9 further comprises a ballast output valve 15*b*, so that ballast can be discharged from the chamber. In instances where air or another light fluid is injected into the chamber while water or another heavy liquid is discharged, the chamber will become more buoyant and increase vertical tension on lower connecting member 5. Conversely, if water or another heavy liquid is injected into the chamber while air is bled out, the chamber will lose buoyancy, thereby lessening vertical tension on lower connecting member 5.

In alternative embodiments, the ballast output valve is disposed in communication with one or more pumps or compressors, so that ballast is ejected from the chamber in a more reliable and controlled manner. In some embodiments, the ballast output valve is disposed in communication with an umbilical, so that ballast ejected from the chamber can be recovered or recycled at the surface. In any event, a principle advantage of the present invention is that adjustments to the chamber's buoyancy and tensioning properties, and the ability to control the height of the well terminal member 14, can be performed at any time during either exploration or production, due to the various ballast input and output control means disposed about the body of the chamber.

In further embodiments, adjustable buoyancy chamber 9 is further disposed in communication with one or more tension lines 10 provided to anchor the adjustable buoyancy chamber to the sea floor. As before, tension lines 10 are anchored to the sea floor using known anchoring technology, for example, suction anchors or dead weight type anchors, etc. The one or more tension lines 10 can also provide additional lateral stability for the system, especially during operations in which more than one well is being worked. In one embodiment, the one or more tension lines 10 are run from the adjustable buoyancy chamber 9 to the surface, and then moored to other buoys or a surface vessel, etc., so that even greater lateral tension and system stability are achieved. In further embodiments, the tension lines 10 are individually adjustable, whereas in other embodiments, the tension lines 10 are collectively controlled. In still further embodiments, the one or more tension lines 10 are both individually and collectively adjustable.

In one example embodiment, adjustable buoyancy chamber 9 is disposed in communication with a vertical tension receiving member 11. In another embodiment, the vertical tension receiving member 11 is equipped with a tension measuring means (e.g., a load cell 16, strain gauge, etc.), so that vertical tension applied to lower connecting member 5 is imparted in a more controlled and efficient manner. In another embodiment, the buoyant force applied to tension receiving member 11 is adjusted by varying the lengths of tension lines 10, while the buoyancy of adjustable buoyancy chamber 9 is held approximately constant. In a further embodiment, the buoyancy of adjustable buoyancy chamber 9 is controlled by means of one or more individually selectable ballast exhaust ports disposed about the body of the chamber, which vent excess ballast fluid to the surrounding sea. In still further embodiments, the open or closed state of the ballast exhaust ports are individually controlled using port controllers known to those of ordinary skill in the art (e.g., plugs, seacocks, etc.).

In a presently preferred embodiment, the system is disposed so that a well terminal member 14 installed above buoyancy chamber 9 is submerged to a depth at which maintenance and testing can be carried out by SCUBA divers using lightweight, flexible diving equipment, for example, at a depth of about 100 to 300 feet beneath the surface. In some embodiments, the well terminal member 14 is submerged only to the minimum depth necessary to provide topside access to the hulls of various surface vessels servicing the well, meaning that well terminal member 14 could also be disposed at a much shallower depth, for example, a depth of about 50 to 100 feet. In alternative embodiments, well terminal member 14 is disposed at depths of less than 50 feet, or greater than 300 feet, depending upon the actual conditions surrounding operations. In still further embodiments, well terminal member 14 is disposed either at the surface or above the surface of the water, and a blowout preventer or a production tree is installed by workers operating aboard a service platform or surface vessel. This "damp tree" model avoids the need to assemble long subsurface riser stacks, as would generally be required during deepwater operations. Moreover, disposing the well terminal member at or near the surface also permits testing and maintenance to be carried out by SCUBA divers or surface crews, without the need for expensive and time-consuming remote operated vehicle operations.

In some embodiments, well terminal member 14 further comprises either a blowout preventer or a production tree. In a presently preferred embodiment, however, well terminal member 14 further comprises a combined blowout preventer and production tree assembly configured so as to facilitate simplified well intervention operations.

In some embodiments, lower connecting member 5 terminates within the void formed in a center portion of the annular chamber 9, at which point an upper connecting member 12 becomes the means by which fluids are transported up to the wellhead. In other embodiments, lower connecting member 5 does not terminate within the void formed in a center portion of the annular chamber, but instead runs through the void and is subsequently employed as an upper connecting member 12 disposed between the chamber and the wellhead. In other embodiments, a vertical tension receiving member 11 is disposed between the buoyancy chamber 9 and upper connecting member 12, so that the chamber's buoyant forces are transferred to the vertical tension receiving means 11, thereby applying vertical tension to the drilling or production string extended below the chamber.

In further embodiments, upper connecting member 12 further comprises a well isolation member 13, e.g., one or more ball valves or blowout preventers, used to halt fluid flow in the event that well terminal member 14 is either removed or disabled, for example, during testing and maintenance operations. Those of ordinary skill in the art will appreciate that the precise types and exact locations of isolation valves 13 employed in the system are variable and flexible, the only real requirement being that the valves are capable of allowing or preventing fluid flow from the well 1 during periods in which testing or maintenance, or even an emergency safety condition, are present.

For example, well terminal member 14 can be equipped with a production tree so that a production hose disposed on a surface vessel can be attached to the system and production can commence. Alternatively, well terminal member 14 can terminate in a blowout preventer, so that the well will not blow out during drilling operations. In other embodiments, well terminal member 14 terminates in a combined production tree and blowout preventer assembly to facilitate simplified well intervention operations.

Figure 2B:
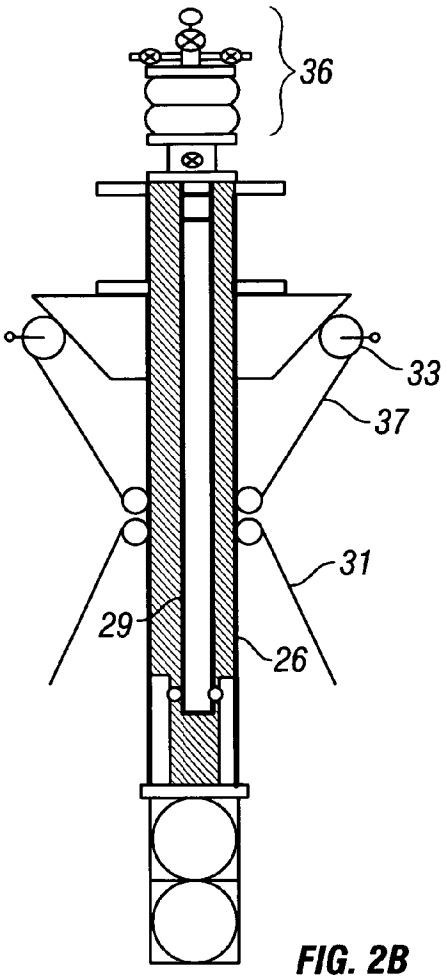
FIGS. 2A and 2B are side views of an offshore exploration and production system, in which lateral and vertical forces on an adjustable buoyancy chamber are held approximately constant while the height of an associated well terminal member is adjusted by releasing additional lengths of tension line.
Figure 2A:
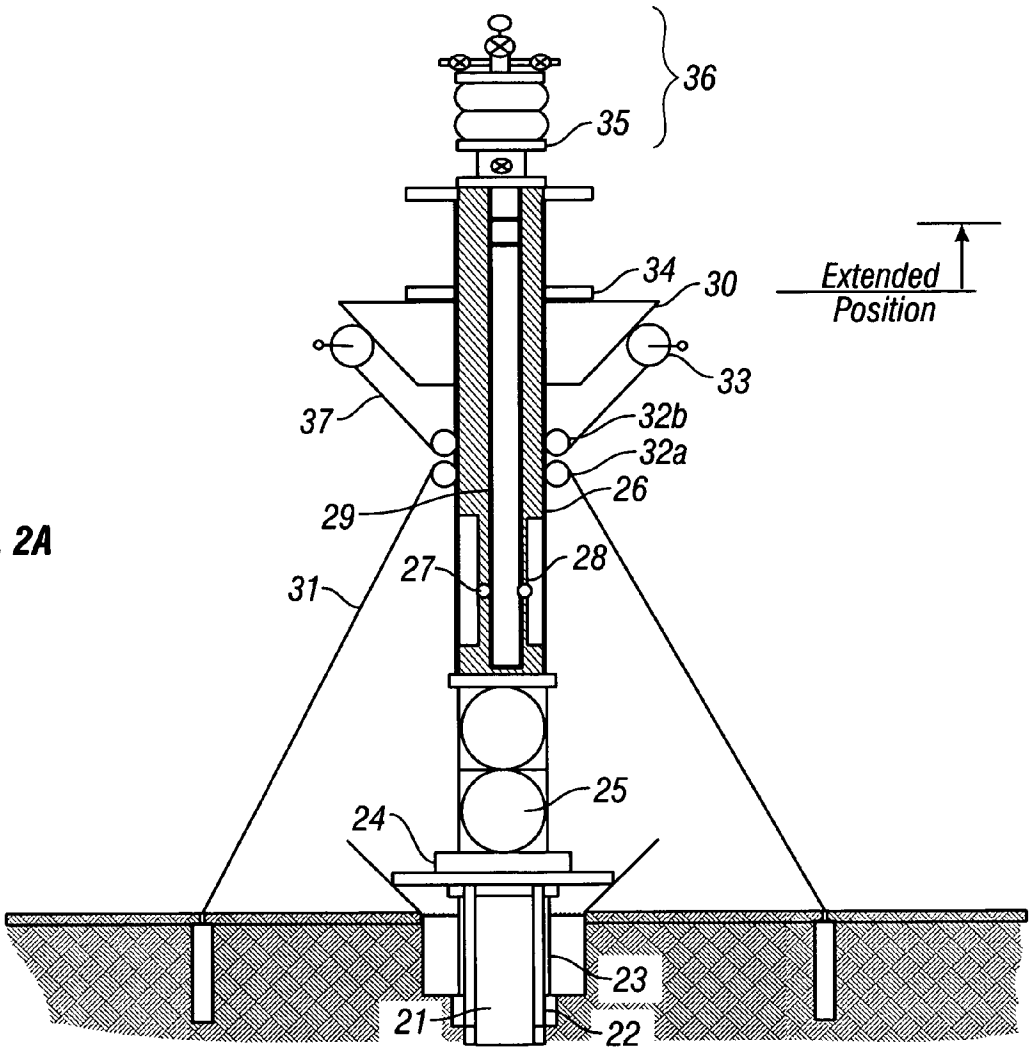

Turning now to the specific, non-limiting embodiments of the invention depicted in FIGS. 2A and 2B, a system and method of establishing a height-variable well terminal member is provided, comprising a lower fluid transport pipe 21, an inner well casing 22, an outer well casing 23, and a wellhead 24. In some embodiments, a well isolation member 25 is disposed above the wellhead 24, so that the well can be closed off or shut in if desired.

In the example embodiment depicted in FIG. 2A, well isolation member 25 further comprises one or more ball valves that can be adjustably opened or closed as desired by an operator. A lower connecting member 26 having one or more interior seals 27 and an interior polished bore 28 houses a fluid transport member 29 such that the height of fluid transport member 29 is variably adjustable within a body portion of lower connecting member 26 in response to vertical lifting forces imparted by adjustable buoyancy chamber 30. Various lengths of pipe define the height of an upper connecting member disposed between the buoyancy chamber 30 and a well terminal member 36. In some embodiments, an upper well isolation member 35, such as a ball valve or a blowout preventer, is disposed in communication with the upper connecting member between buoyancy chamber 30 and well terminal member 36.

In some embodiments, the system is moored to the sea floor using one or more mooring lines 31 connected to a first vertical tension receiving means 32*a*, while buoyancy chamber 30 is raised or lowered by either spooling-out or reeling-in lengths of one or more tension lines 37 disposed between a second vertical tension receiving means 32*b* and a chamber height adjustment means 33. As adjustable buoyancy chamber 30 rises, vertical tension is applied to vertical tension receiving member 34, which in turn lifts well terminal member 36 up toward the surface.

As seen in the example embodiment depicted in FIG. 2B, the height of both the well terminal member 36 and fluid transport member 29 are vertically adjusted by increasing the length of tension lines 37 using chamber height adjustment means 33, even as vertical and lateral tension on mooring lines 31 and tension lines 37 remains approximately constant. In one embodiment, vertical tension on lower connecting member 26 is also kept approximately constant during this process, since fluid transport member 29 is moved vertically within a body portion of lower connecting member 26. In another embodiment, a second, lower adjustable buoyancy chamber is added to the system to maintain tension on lower connecting member 26, while the height of the well terminal member is adjusted as described above.

The foregoing specification is provided for illustrative purposes only, and is not intended to describe all possible aspects of the present invention. Moreover, while the invention has been shown and described in detail with respect to several exemplary embodiments, those of ordinary skill in the pertinent arts will appreciate that minor changes to the description, and various other modifications, omissions and additions may also be made without departing from either the spirit or scope thereof.

The invention claimed is:

1. An offshore exploration and production system, the system comprising:

a well casing disposed in communication with an offshore well;

one or more approximately annular adjustable buoyancy chambers; and a lower connecting member disposed between said well casing and said one or more approximately annular adjustable buoyancy chambers.

2. The system of claim 1, further comprising a well casing disposed in communication with a hole bored into an associated sea floor surface.

3. The system of claim 1, further comprising a well isolation member disposed between said adjustable buoyancy chamber and said lower connecting member.

4. The system of claim 3, wherein said well isolation member further comprises one or more ball valves.

5. The system of claim 3, wherein said well isolation member further comprises a blowout preventer.

6. The system of claim 3, wherein said lower connecting member further comprises a receiving member for receiving an attachment member disposed on said isolation member.

7. The system of claim 3, wherein said lower connecting member further comprises an attachment member for attaching said lower connecting member to a receiving member disposed on said isolation member.

8. The system of claim 1, wherein said lower connecting member further comprises a riser.

9. The system of claim 1, wherein said lower connecting member further comprises a riser pipe.

10. The system of claim 1, wherein said lower connecting member further comprises a casing.

11. The system of claim 1, wherein said lower connecting member further comprises a fluid transport member disposed within an interior portion of said lower connecting member.

12. The system of claim 11, wherein said fluid transport member is height adjustable in response to a buoyant force imparted by said adjustable buoyancy chamber.

13. The system of claim 1, wherein said lower connecting member is disposed in communication with one or more lateral stabilizers.

14. The system of claim 13, wherein said one or more lateral stabilizers further comprises one or more adjustable lateral stabilizers.

15. The system of claim 13, wherein said one or more lateral stabilizers is disposed in communication with one or more tension lines.

16. The system of claim 15, wherein said one or more tension lines further comprises one or more individually adjustable tension lines.

17. The system of claim 15, wherein said one or more tension lines are disposed in communication with one or more anchoring members.

18. The system of claim 1, wherein said lower connecting member is longitudinally disposed through a void formed in said one or more approximately annular adjustable buoyancy chambers.

19. The system of claim 1, wherein one or more of said one or more adjustable buoyancy chambers further comprises a plurality of inner chambers.

20. The system of claim 1, wherein said adjustably buoyancy chamber further comprises a fluid ballast.

21. The system of claim 1, wherein said adjustable buoyancy chamber further comprises a ballast input valve.

22. The system of claim 1, wherein said adjustable buoyancy chamber further comprises a ballast output valve.

23. The system of claim 1, wherein said adjustable buoyancy chamber is disposed in communication with one or more tension lines.

24. The system of claim 23, wherein said one or more tension lines further comprises one or more individually adjustable tension lines.

25. The system of claim 23, wherein said one or more tension lines is disposed in communication with one or more anchoring members.

26. The system of claim 1, wherein said adjustable buoyancy chamber is disposed in communication with a vertical tension receiving member.

27. The system of claim 26, wherein said tension receiving member is disposed in communication with a tension measuring means.

28. The system of claim 27, wherein said tension measuring means further comprises a load cell.

29. The system of claim 1, wherein said adjustably buoyancy chamber is disposed in communication with an upper well isolation member.

30. The system of claim 29, wherein said upper well isolation member further comprises a ball valve.

31. The system of claim 29, wherein said upper well isolation member further comprises a blowout preventer.

32. The system of claim 1, wherein said adjustable buoyancy chamber is disposed in communication with an upper connecting member.

33. The system of claim 32, wherein said upper connecting member is disposed in communication with a well terminal member.

34. The system of claim 33, wherein said well terminal member further comprises a production tree.

35. The system of claim 33, wherein said well terminal member further comprises a blowout preventer.

36. The system of claim 33, wherein said well terminal member further comprises a combined production tree and blowout preventer assembly.

37. A method of installing and maintaining an offshore exploration and production system, the method comprising:

disposing a well casing in communication with an offshore well;

disposing a lower connecting member between said well casing and one or more approximately annular adjustable buoyancy chambers; and disposing said one or more adjustable buoyancy chambers in communication with a tension receiving member.

38. The method of claim 37, further comprising cementing said well casing into a hole bored into a sea floor surface.

39. The method of claim 37, further comprising disposing a well isolation member between said adjustable buoyancy chamber and said lower connecting member.

40. The method of claim 39, wherein said disposing a well isolation member further comprises disposing a well isolation member having one or more ball valves.

41. The method of claim 39, wherein said disposing a well isolation member further comprises disposing a well isolation member having a blowout preventer.

42. The method of claim 39, further comprising disposing a well isolation member having an attachment member for attaching said well isolation member to a receiving member disposed on said lower connecting member.

43. The method of claim 39, further comprising disposing a well isolation member having a receiving member for receiving an attachment member disposed on said lower connecting member.

44. The method of claim 37, wherein said disposing a lower connecting member further comprises disposing a riser.

45. The method claim 37, wherein said disposing a lower connecting member further comprises disposing a riser pipe.

46. The method of claim 37, wherein said disposing a lower connecting member further comprises disposing a casing.

47. The method of claim 37, wherein said disposing a lower connecting member further comprises disposing a fluid transport member housed within an interior portion of said lower connecting member.

48. The method of claim 47, further comprising adjusting the length of one or more associated tension lines so as to variably adjust the height of said fluid transport member.

49. The method of claim 37, further comprising disposing a lower connecting member in communication with one or more lateral stabilizers.

50. The method of claim 49, further comprising disposing a lower connecting member in communication with one or more adjustable lateral stabilizers.

51. The method of claim 49, further comprising disposing said one or more lateral stabilizers in communication with one or more tension lines.

52. The method of claim 51, further comprising disposing said one or more lateral stabilizers in communication with one or more adjustable tension lines.

53. The method of claim 51, further comprising disposing said one or more tension lines in communication with one or more anchoring members.

54. The method of claim 37, further comprising disposing said lower connecting member longitudinally through a void formed in said one or more approximately annular adjustable buoyancy chambers.

55. The method of claim 37, further comprising disposing one or more adjustable buoyancy chambers having a plurality of inner chambers.

56. The method of claim 37, further comprising disposing an adjustable buoyancy chamber having a fluid ballast.

57. The method of claim 37, further comprising disposing an adjustable buoyancy chamber having a fluid input valve.

58. The method of claim 37, further comprising disposing an adjustable buoyancy chamber having a fluid output valve.

59. The method of claim 37, further comprising disposing an adjustable buoyancy chamber in communication with one or more adjustable tension lines.

60. The method of claim 59, further comprising disposing an adjustable buoyancy chamber in communication with one or more individually adjustable tension lines.

61. The method of claim 59, further comprising disposing said one or more tension lines in communication with one or more anchoring members.

62. The method of claim 37, further comprising disposing said tension receiving member in communication with a tension measuring means.

63. The method of claim 62 wherein said disposing said tension receiving member in communication with a tension measuring means further comprises disposing said tension receiving member in communication with a load cell.

64. The method of claim 37, further comprising disposing an adjustable buoyancy chamber in communication with a well isolation member.

65. The method of claim 64, further comprising disposing an adjustable buoyancy chamber in communication with a well isolation member having a ball valve.

66. The method of claim 64, further comprising disposing an adjustable buoyancy chamber in communication with a well isolation member having a blowout preventer.

67. The method of claim 37, further comprising disposing an adjustable buoyancy chamber in communication with an upper connecting member.

68. The method of claim 67, further comprising disposing said upper connecting member in communication with a well terminal member.

69. The method of claim 68, further comprising disposing said upper connecting member in communication with a blowout preventer.

70. The method of claim 68, further comprising disposing said upper connecting member in communication with a production tree.

71. The method of claim 68, further comprising disposing said upper connecting member in communication with a combined production tree and blowout preventer assembly.

* * * * *